US007025575B2

(12) United States Patent
Noh et al.

(10) Patent No.: US 7,025,575 B2
(45) Date of Patent: Apr. 11, 2006

(54) RECIPROCATING COMPRESSOR WITH VIBRATION REDUCING PLATE

(75) Inventors: Ki Won Noh, Seoul (KR); Hyeong Seok Kim, Seoul (KR); Dong Han Kim, Seoul (KR); Byung Jik Kim, Seoul (KR); Hyung Jin Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/893,365

(22) Filed: Jul. 19, 2004

(65) Prior Publication Data

US 2005/0053489 A1 Mar. 10, 2005

(30) Foreign Application Priority Data

Aug. 11, 2003 (KR) ..... 10-2003-0055504

(51) Int. Cl.
*F04B 35/04* (2006.01)

(52) U.S. Cl. ..... 417/363; 417/417

(58) Field of Classification Search ..... 417/416, 417/417, 902, 363; 184/6.28
See application file for complete search history.

(56) References Cited

U.S. PATENT DOCUMENTS 3,788,778 A * 1/1974 Miller ..... 417/417
4,832,583 A * 5/1989 Brown ..... 417/417
6,398,523 B1 * 6/2002 Hur et al. ..... 417/417

* cited by examiner

*Primary Examiner*—Charles G. Freay
(74) *Attorney, Agent, or Firm*—Greenblum & Bernstein, P.L.C.

(57) ABSTRACT

A reciprocating compressor includes a case to which a suction pipe and a discharge pipe are respectively connected, having a closed space; a reciprocating motor disposed inside the case, for generating a reciprocating force; a compressing unit receiving the reciprocating force generated from the reciprocating motor, for compressing a fluid; and a separation plate for dividing the closed space of the case into a low pressure portion into which a fluid is sucked through the suction pipe and a high pressure portion from which a fluid compressed in the compressing unit is discharged. Accordingly, the reciprocating compressor cuts off vibration generated from the compressing unit and the reciprocating motor and thus reduce the vibration transmitted to the compressor case and other elements so that noise can be reduced, life spans of other elements can be lengthened, and reliability of the compressor can be improved.

13 Claims, 4 Drawing Sheets

RECIPROCATING COMPRESSOR WITH VIBRATION REDUCING PLATE

BACKGROUND OF THE INVENTION

1. Field of the Invention

The present invention relates to a reciprocating compressor, and more particularly, to a reciprocating compressor capable of reducing the amount of vibration transmitted to other elements after being generated in the compressor.

2. Description of the Background Art

In general, a compressor is divided into a rotary compressor, a reciprocating compressor and a scroll compressor according to a method for compressing a fluid.

FIG. 1 is a sectional view of a reciprocating compressor in accordance with the present invention.

The reciprocating compressor in accordance with the present invention includes a case 106 having a closed space; a reciprocating motor 108 disposed inside the case 106, for generating a reciprocating force; a compressing unit 110 receiving the reciprocating force generated from the reciprocating motor 108, for compressing a fluid; and a frame unit 130, 132, 134 for supporting each element.

A suction pipe 102 for sucking a fluid is connected to an upper portion of the case 106, a discharge pipe 104 for discharging a compressed fluid is connected to a lower side surface of the case 106, and a lower portion of the case 106 is filled with the certain amount of lubricating oil 112 for lubrication. And the discharge pipe 104 is sealably mounted to the case 106 and connected to the compressing unit 110 by a loop pipe 114.

The loop pipe 114 is formed in a winding form and reduces the amount of vibration transmitted to the discharge pipe 104 after being generated from the compressing unit 110.

The reciprocating motor 108 includes an outer stator 118 having a cylindrical shape, in which a winding coil to which power is applied is wound; an inner stator 120 disposed at a certain air gap between itself and an inner circumferential surface of the outer stator 118; and magnets 124 disposed between the outer stator 118 and the inner stator 120 at regular intervals and linearly reciprocating when power is applied to the winding coil 122.

The magnets 124 are fixed to an outer circumferential surface of a magnet holder 126 at regular intervals, the magnet holder 126 is connected to the piston 128 of the compressing unit 110, and the piston 128 is connected to a spring support bar 140.

The frame unit 130, 132, 134 includes first and second frames 130, 132 installed at both sides of the reciprocating compressor 108, for supporting the reciprocating compressor 108; and a third frame 134 connected to the second frame 132, for supporting the compressing unit 108.

A first resonant spring 146 is installed between one side of the spring support bar 140 and the first frame 130, and a second resonant spring 148 is installed between the other side of the spring support bar 140 and the second frame 132, thereby inducing a resonant movement of the piston 128.

The compressing unit 110 includes the piston 128 connected to the magnet holder 126 and linearly reciprocating; a cylinder 152 in which the piston 128 is slidably inserted, forming a compressing chamber 150 and fixed to the first frame 130; a suction valve 156 mounted to the front of the piston 128, for opening/closing a fluid passage 154 formed at the piston 128; and a discharge valve assembly 160 mounted to the front of the cylinder 152, for opening/closing a discharge passage 158 through which a fluid is discharged.

Here, the discharge valve assembly 160 includes a discharge valve 162 adhered to a front surface of the cylinder 152 and opened/closed; a discharge cover 164 mounted to the front of the cylinder 152, connected to the loop pipe 114 and having a discharge passage 158; a spring 166 installed between an inner surface of the discharge cover 165 and the discharge valve 162, for elastically supporting the discharge valve 162.

A first support spring 170 is installed between the third frame 134 and an upper surface of the case 106, and a second support spring 172 is installed between the discharge cover 165 and a lower surface of the case 106, thereby reducing the amount of vibration transmitted to the case 106 after being generated from the reciprocating motor 108 and the compressing unit 110

However, in the reciprocating compressor constructed as above, since a discharge pipe 104 through which a compressed fluid is discharged to other elements is fixed to a case 106 and connected to a discharge cover 164 of a compressing unit 110 by a loop pipe 114, vibration generated when the compressing unit 110 is driven is transmitted to the case 106 through the loop pipe 114 and also transmitted to other elements through the discharge pipe 104. Accordingly, noise is generated from the compressor, reliability of the elements is degraded, and their life spans are shortened.

SUMMARY OF THE INVENTION

Therefore, an object of the present invention is to provide a reciprocating compressor capable of reducing noise, lengthening life spans of other elements and improving its reliability by reducing vibration of a compressor by cutting off vibration transmitted to a compressor case and other elements after being generated from a compressing unit and a reciprocating motor.

To achieve these and other advantages and in accordance with the purpose of the present invention, as embodied and broadly described herein, there is provided a reciprocating compressor comprising: a case to which a suction pipe and a discharge pipe are respectively connected, having a closed space; a reciprocating motor disposed inside the case, for generating a reciprocating force; a compressing unit receiving the reciprocating force generated from the reciprocating motor, for compressing a fluid; and a separation plate for dividing the closed space of the case into a low pressure portion into which a fluid is sucked through the suction pipe and a high pressure portion from which a fluid compressed in the compressing unit is discharged.

The discharge pipe is connected to a lower side of the case and communicates with the high pressure portion. The separation plate is formed in a disc type and has an inner circumferential surface sealably fixed to an outer circumferential surface of a discharge cover of the compressing unit and an outer circumferential surface sealably fixed to an inner circumferential surface of the case.

The separation plate has a radially rippled bellows form and elastically deformed by vibration of the compressing unit.

The high pressure unit is formed as a space communicating with a discharge passage of the compressing unit, in which a compressed fluid is temporarily stored, and the low pressure unit formed by the separation plate is filled with lubricating oil.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

There may exist a plurality of embodiments for a reciprocating compressor in accordance with the present invention, and hereinafter, the most preferred embodiments will now be described.

Figure 1:
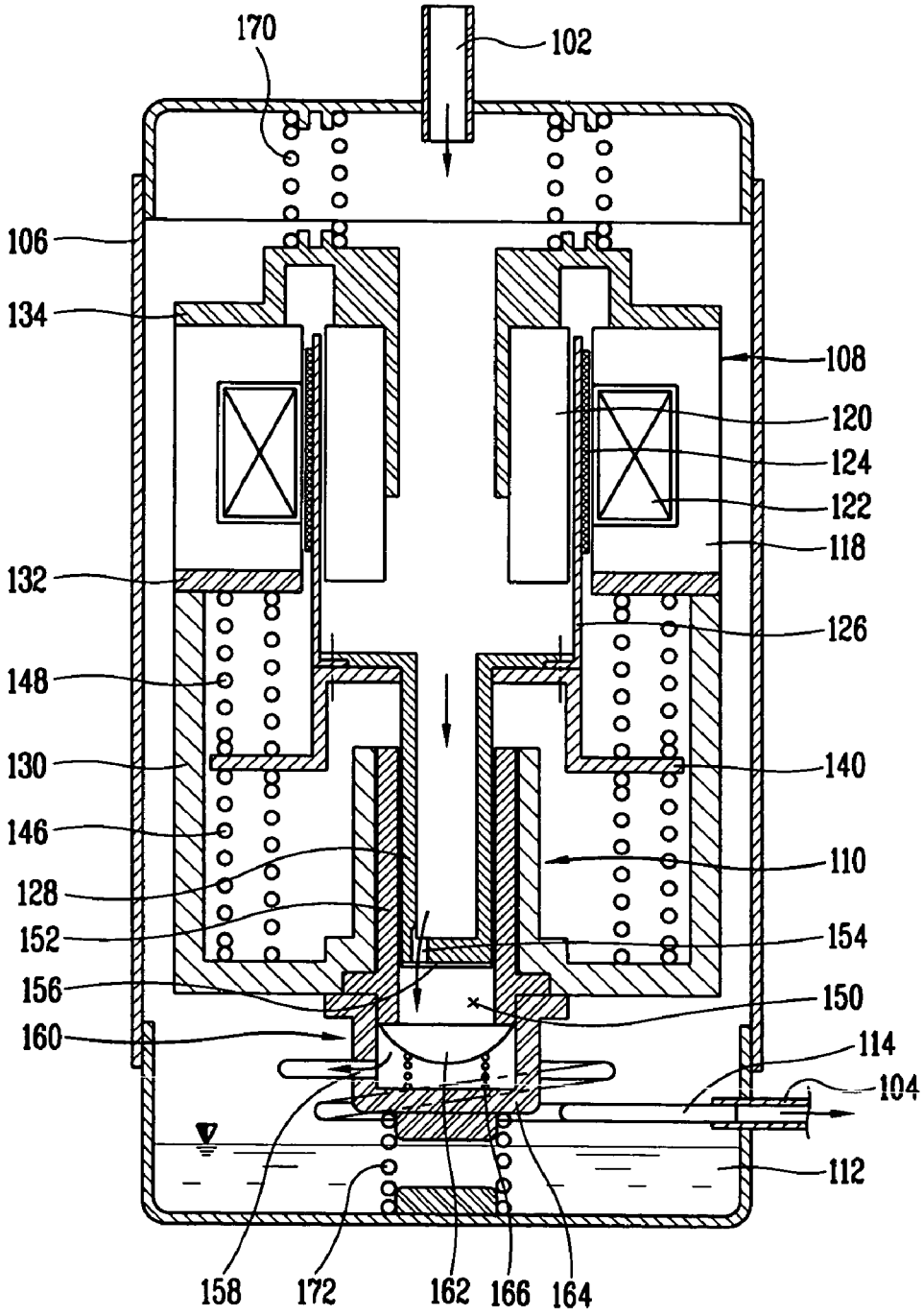
FIG. 1 CONVENTIONAL ART
FIG. 1 is a sectional view of a reciprocating compressor in accordance with the conventional art.
Figure 2:
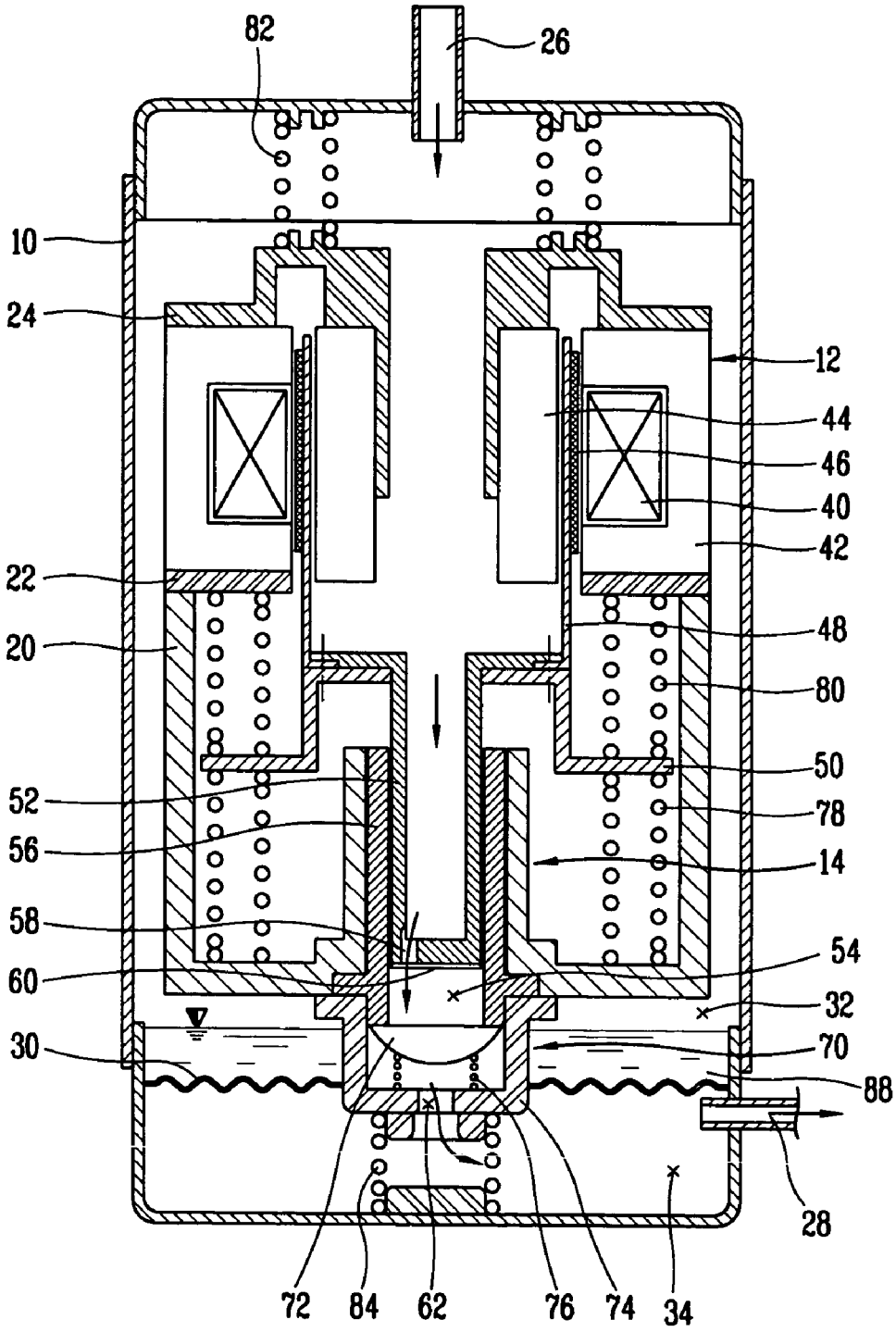
FIG. 2 is a sectional view of a reciprocating compressor in accordance with one embodiment of the present invention.

FIG. 2 is a sectional view of a reciprocating compressor in accordance with one embodiment of the present invention.

A reciprocating compressor includes: a case 10 having a closed space; a reciprocating motor 12 disposed inside the case 10, for generating a reciprocating force when power is applied thereto; a compressing unit 14 receiving the reciprocating force generated from the reciprocating motor 12, for compressing a fluid; and a frame assembly 20, 22, 24 for supporting the reciprocating motor 12 and the compressing unit 14.

A suction pipe 26 through which a fluid is sucked is connected to an upper portion of the case 10, a discharge pipe 28 through which a compressed fluid is discharged is connected to a lower side surface of the case 10, and a separation plate 30 for dividing the closed space into a high pressure portion 34 and a lower pressure portion 32 is mounted in the case 10.

The reciprocating motor 12 includes an outer stator 42 having an cylindrical shape, in which a winding coil 40 to which power is applied is wound; an inner stator 44 disposed at a certain air gap between itself and an inner circumferential surface of the outer stator 42; and magnets 46 reciprocably disposed at the air gap between the outer stator 42 and the inner stator 44.

Here, the magnets 46 are fixed to an outer circumferential surface of a magnet holder 48 at regular intervals in a circumferential direction, and the magnet holder 48 is connected to a spring support bar 50 and a piston 52 of the compressing unit 14.

The compressing unit 14 includes a piston 52 connected to the magnet holder 48 and reciprocated; a cylinder 56 in which the piston 52 is slidably inserted, forming a compressing chamber 54; a suction valve 60 mounted to the front of the piston 52, for opening/closing a fluid passage 58 formed at the piston 52; and a discharge valve assembly 70 mounted to the front of the cylinder 56, for opening/closing a discharge passage 62 through which a fluid is discharged.

The discharge valve assembly 70 includes a discharge valve 72 contacted to the front surface of the cylinder 56, for performing an opening/closing operation; a discharge cover 74 mounted to the front of the cylinder 56 and having a discharge passage 62 through which a compressed fluid is discharged; and a spring 76 disposed between an inner surface of the discharge cover 74 and the discharge valve 72, for elastically supporting the discharge valve 72.

The frame assembly 20, 22, 24 includes a first frame 20 fixed to an outer circumferential surface of the cylinder 56, for supporting the cylinder 56; a second frame 22 coupled to the first frame 20, for supporting one side of the outer stator 42; a third frame 24 for supporting the other side of the outer stator 42 and the inner stator.

A first resonant spring 78 is installed between one side of the spring support bar 50 and the first frame 20, and a second resonant spring 80 is installed between the other side of the spring support bar 50 and the second frame 22, thereby inducing a resonant movement of the piston 52.

A first support spring 82 is installed between the third frame 24 and an upper surface of the case 10, a second support spring 84 is installed between the discharge cover 74 and a lower surface of the case 10, thereby reducing the amount of vibration transmitted to the case 10 after being generated from the compressing unit 14 and the reciprocating motor 12.

Figure 3:
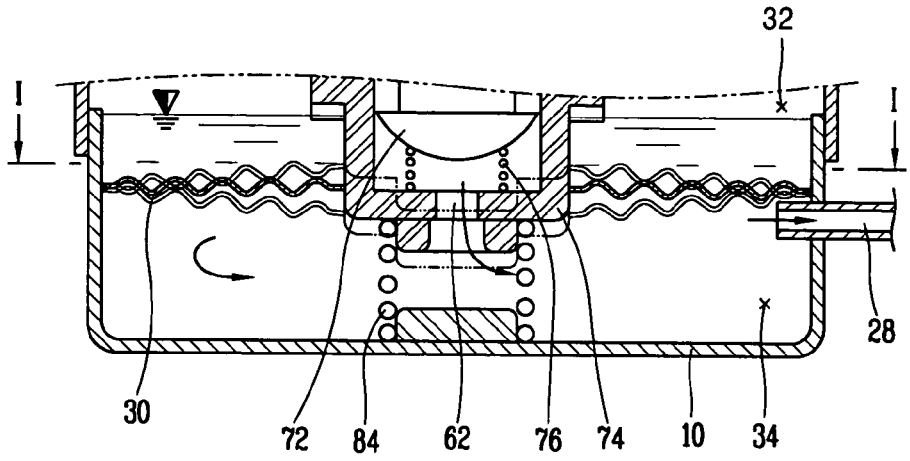
FIG. 3 is a sectional view showing a main part of a reciprocating compressor in accordance with one embodiment of the present invention.
Figure 4:
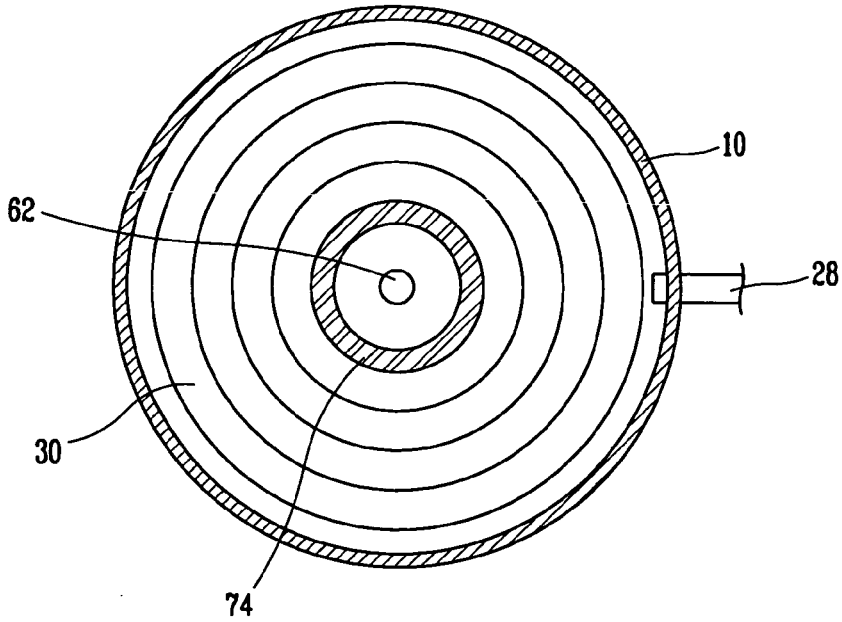
FIG. 4 is a sectional view taken along line IV—IV of FIG. 3.

As shown in FIGS. 3 and 4, the separation plate 30 is formed in a disc shape a central portion of which is opened and has an inner circumferential surface fixed to an outer circumferential surface of the discharge cover 74 and an outer circumferential surface fixed to an inner circumferential surface of the case 10. By the separation unit, the closed space of the case 10 is divided into a low pressure portion 32, an upper side where the reciprocating motor 12 and the compressing unit 14 are installed and a high pressure portion 34, a lower side where a fluid compressed in the compressing unit 14 is discharged.

Such a separation plate 30 is formed as a radially-rippled bellows and absorbs vibration, being deformed when the compressing unit 14 is vibrated in a vertical or horizontal direction and so reduces the vibration transmitted to the case 10. Preferably, the separation plate 30 is formed as a steel bellows.

And, the upper side of the separation plate 30, that is, the low pressure portion 32 is filled with the certain amount of lubrication oil 88 for lubricating the compressing unit 14.

The discharge passage 62 is formed penetrating the lower portion of the discharge cover 74 and communicates with the high pressure portion 34. Accordingly, a fluid discharged through the discharge passage 62 is temporarily stored in the high pressure portion 34 and supplied to other elements through the discharge pipe 28. And, the discharge pipe 28 is mounted at a lower side surface of the case 10 and communicates with the high pressure portion 34.

Operations of the reciprocating compressor in accordance with the present invention constructed as above will now be described.

When a fluid is sucked into a low pressure portion 32 in a case 10 through a suction pipe 26, and power is applied to a reciprocating motor 12, a reciprocating force is generated, and a piston 52 of a compressing unit 14 is reciprocated by the reciprocating force, thereby compressing the fluid.

Then, the fluid compressed by a reciprocating motion of the piston 52 is discharged to a high pressure portion 34 in a case 10 through a discharge passage 62 formed at a discharge cover 74 and the fluid discharged to the high pressure portion 34 is transmitted to other elements through a discharge pipe 28.

Here, a closed space of the case 10 is divided into a low pressure portion 32 and a high pressure portion 34 by the separation plate 30. Thus, the fluid is sucked into the low pressure portion 32, and the fluid sucked into the low pressure portion is compressed by a compressing unit 14, discharged to the high pressure portion 34 and transmitted to other elements through the discharge pipe 28 connected to the high pressure portion 34.

Thus, since the discharge pipe 28 is not connected to the compressing unit 1, vibration generated from the compressing unit 14 is cut off so as not to be transmitted to the discharge pipe 28, and thus vibration transmitted to other elements through the discharge pipe 28 can be reduced.

In addition, the separation plate 30 has a bellows form and thus is deformed to absorb the vibration when the compressing unit 14 is vibrated in a vertical or horizontal direction, so that vibration transmitted to the case 10 is reduced.

Figure 5:
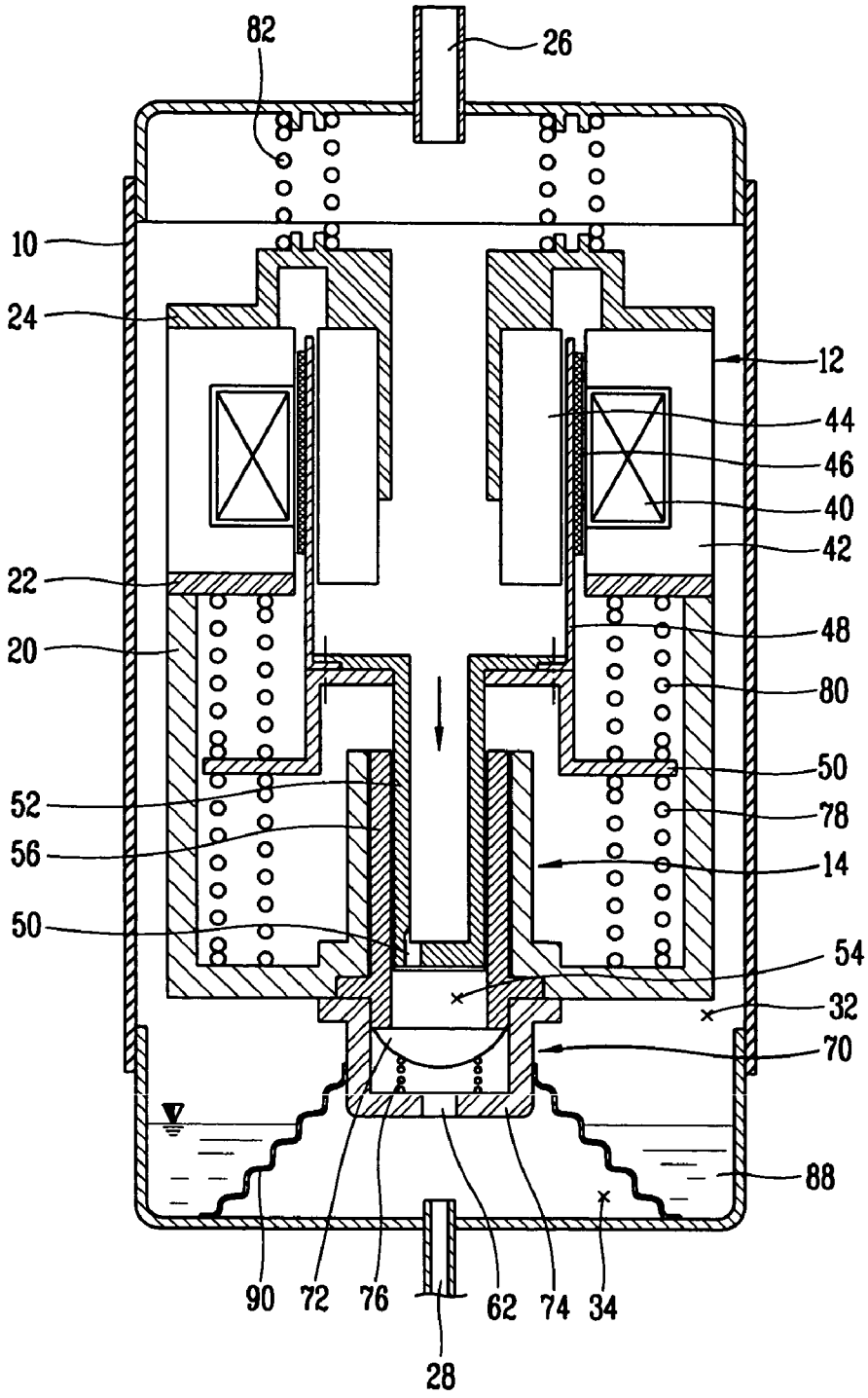
FIG. 5 is a sectional view of a reciprocating compressor in accordance with another embodiment of the present invention.

FIG. 5 is a sectional view of a reciprocating compressor having a separation plate in accordance with another embodiment of the present invention.

A separation plate 90 in accordance with another embodiment has a conical shape, and as it goes to a lower portion, its diameter gets wider. Also, the separation plate 90 has a radially-rippled bellows form and has its own certain elastic force.

Such a separation plate 90 in accordance with another embodiment of the present invention has an inner circumferential surface fixed to an outer circumferential surface of a discharge cover 74 and an outer circumferential surface fixed to a bottom of the case 10, so that the separation plate 90 elastically supports a lower portion of the compressing unit 14 and also divides the inside of the case 10 into a low pressure portion 32 and a high pressure portion 34.

And, a discharge pipe 29 of the reciprocating compressor in accordance with another embodiment is connected to a lower portion of the case 10 and communicates with the high pressure portion 34.

In a reciprocating compressor in accordance with the present invention constructed and operated as above, a separation plate 30 is installed in a closed space of a case 10 and divides the closed space into a low pressure portion 32 and a high pressure portion 34, so that a compressed fluid is discharged to the high pressure portion 34 and then transmitted to other elements through a discharge pipe 38. Hence, there is no need to connect the discharge pipe 29 and a compressing unit 14 by a special pipe or the like. Accordingly, vibration transmitted to the discharge pipe 28 after being generated from the compressing unit 14 can be cut off, and so the vibration transmitted to other elements connected to the discharge pipe 28 can be reduced. And, by forming the separation plate 30 in a bellows form, the separation plate 30 absorbs vibration generated from the compressing unit 14 and thus reduces the vibration transmitted to the case 10.

Accordingly, reliability of the compressor can be reduced, life spans of other elements can be lengthened, and noise due to vibration can be reduced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A reciprocating compressor comprising:

a case to which a suction pipe and a discharge pipe are respectively connected, the case providing a defined space therein;

a reciprocating motor disposed inside the case, the reciprocating motor generating a reciprocating force;

a compressing unit that receives the reciprocating force generated by the reciprocating motor, and that compresses a fluid; and a separation plate for dividing the defined space of the case into a low pressure portion into which a fluid is sucked through the suction pipe and a high pressure portion from which a fluid compressed in the compressing unit is discharged, the separation plate comprising an elastic member that absorbs vibration generated by the compressing unit.

2. The reciprocating compressor of claim 1, wherein the discharge pipe is connected to a lower side surface of the case and communicates with the high pressure portion.

3. The reciprocating compressor of claim 1, wherein the separation plate comprises a disc-like shape and has an inner circumferential surface sealingly fixed to an outer circumferential surface of a discharge cover of the compressing unit and an outer circumferential surface sealingly fixed to an inner circumferential surface of the case.

4. The reciprocating compressor of claim 3, wherein the separation plate has a radially rippled bellows form.

5. The reciprocating compressor of claim 1, wherein the high pressure portion comprises a space communicating with a discharge passage of the compressing unit, in which a compressed fluid is temporarily stored.

6. The reciprocating compressor of claim 1, wherein the low pressure portion formed by the separation plate contains lubricating oil.

7. The reciprocating compressor of claim 1, wherein the separation plate comprises a conically shaped member.

8. The reciprocating compressor of claim 1, wherein the separation plate has an inner circumferential surface fixed to an outer circumferential surface of a discharge cover of the compressing unit and an outer circumferential surface sealingly fixed to a bottom of the case.

9. The reciprocating compressor of claim 7, wherein the separation plate has a radially rippled bellows form.

10. The reciprocating compressor of claim 7, wherein the discharge pipe is connected to a lower portion of the case and communicates with the high pressure portion.

11. The reciprocating compressor of claim 1, wherein a portion of the separating plate is attached to a moveable member of the compression unit.

12. The reciprocating compressor of claim 1, wherein the separation plate comprises a metal bellows.

13. The reciprocating compressor of claim 1, wherein the separation plate comprises a disk having a central opening, an inner circumferential surface of the separation plate fixed to an outer circumferential surface of the compression unit and an outer circumferential surface of the separation plate fixed to an inner circumferential surface of the case.

* * * * *